US011668550B2

(12) United States Patent
Isle et al.

(10) Patent No.: US 11,668,550 B2
(45) Date of Patent: Jun. 6, 2023

(54) SCALABLE INSENSITIVE MUNITIONS PRIMER

(71) Applicant: BAE Systems Land & Armaments L.P., Arlington, VA (US)

(72) Inventors: Brian J. Isle, Brooklyn Park, MN (US); Charles M. Bies, Andover, MN (US)

(73) Assignee: BAE Systems Land & Armaments L.P., Arlington, VA (US)

( * ) Notice: Subject to any disclaimer, the term of this patent is extended or adjusted under 35 U.S.C. 154(b) by 0 days.

(21) Appl. No.: 16/593,419

(22) Filed: Oct. 4, 2019

(65) Prior Publication Data

US 2021/0102791 A1 Apr. 8, 2021

(51) Int. Cl.
*F42C 19/08* (2006.01)
*F42C 19/12* (2006.01)
*F42B 12/20* (2006.01)

(52) U.S. Cl.
CPC ..... *F42C 19/0807* (2013.01); *F42C 19/12* (2013.01); *F42B 12/207* (2013.01)

(58) Field of Classification Search
CPC ..... F42B 12/207; F42C 19/0807; F42C 19/0823; F42C 19/0826; F42C 19/12
USPC ..... 102/202.1
See application file for complete search history.

(56) References Cited

U.S. PATENT DOCUMENTS 2,696,191 A * 12/1954 Sheehan ..... F42C 19/12 102/202.9
3,182,595 A * 5/1965 Hassmann ..... F42C 19/0826 102/202
3,482,518 A * 12/1969 Sweetman ..... F42C 19/0826 102/205
3,744,421 A 7/1973 Seeger
4,648,319 A * 3/1987 Westerlund ..... F42C 19/0826 102/202.12
4,770,099 A * 9/1988 Brede ..... F42C 19/12 102/472
4,881,463 A * 11/1989 Ninio ..... F42B 3/188 102/202.2
5,034,073 A 7/1991 Barry et al.
5,155,295 A * 10/1992 Campoli ..... F42B 5/045 102/430
5,325,782 A 7/1994 Strauss et al.
5,465,665 A * 11/1995 Diehl ..... F42C 19/0826 102/202
5,507,893 A 4/1996 Mullay et al.
(Continued)

FOREIGN PATENT DOCUMENTS

WO WO 2012/126554 9/2012

*Primary Examiner* — Joshua E Freeman
*Assistant Examiner* — Benjamin S Gomberg
(74) *Attorney, Agent, or Firm* — Patterson Thuente IP

(57) ABSTRACT

An insensitive munitions (IM) primer for use with major caliber gun systems, including an elongate housing, a tube, an ignition assembly, and a booster assembly. The elongate housing has a proximal end and a distal end. The tube has a first end coupled within the distal end of the elongate housing. The ignition assembly is located within the proximal end of the housing. The booster assembly is located within the elongate housing adjacent the ignition assembly and including a booster holder providing a cylindrical structure defining an internal bore in which a first burst disk resides and is mechanically restrained by a booster disk lock.

16 Claims, 9 Drawing Sheets

(56) References Cited

U.S. PATENT DOCUMENTS

| | | | | |
|---|---|---|---|---|
| 5,675,115 | A * | 10/1997 | Hershkowitz | F42C 19/0811 102/200 |
| 6,286,432 | B1 * | 9/2001 | Reider | F42C 19/0807 102/202 |
| 6,508,894 | B1 | 1/2003 | Beaupré et al. | |
| 6,543,363 | B2 * | 4/2003 | Brion | F42B 5/181 102/431 |
| 7,574,960 | B1 * | 8/2009 | Dockery | F42B 3/12 102/202.14 |
| 8,425,703 | B1 | 4/2013 | Michienzi et al. | |
| 8,607,702 | B1 * | 12/2013 | Donadio | F42C 19/12 102/202.5 |

* cited by examiner

SCALABLE INSENSITIVE MUNITIONS PRIMER

TECHNICAL FIELD

This disclosure relates to primers for munitions, and more particularly, to scalable, electrically initiated primers for major caliber gun systems that improve the survivability of a propelling charge system exposed to insensitive munitions (IM) stimuli.

BACKGROUND OF THE INVENTION

Charges for major caliber guns with high-energy properties can raise safety concerns due to the risk that unplanned or inadvertent stimuli could cause unwanted ignition of the propelling charges. Primers that increase the safety of such charges have been desired and sought by those in the industry. Specifically, there remains a need for a major caliber gun propellant ignition device (primer) that supports the safety of multiple munitions applications across a variety of platforms. For example, support for non-conventional variants of projectiles, some with mid-body obturators, is desired as such variants complicate propelling charge interchangability.

In general, a design that uses common components between versions is desired for improved affordability and reliability. Further, a design that uses commercially available energetic materials and commercially available shipping methods is desired to reduce reliance on special military documentation and requirements.

In minor caliber applications, prior art primers have been used in 57 mm encased ammunition (Bofors 3P) to reduce the IM response of the system when combined with other system features, such as a brass cartridge case or pressure release feature. However, major caliber cartridges of the prior art generally have failed IM tests.

Accordingly, a there is a desire for a safe and scalable primer for major caliber gun systems that improve the survivability of a propelling charge system.

SUMMARY OF THE INVENTION

Embodiments generally relate to scalable, electrically initiated, IM primers for major caliber gun systems. Embodiments of IM primers improve the survivability of propelling charge systems to IM stimuli and support a plurality of system level requirements. Some embodiments of IM primers can support multiple munitions applications in a variety of platforms. Some embodiments of IM primers utilize commonality of component between versions to improve affordability and reliability. Some embodiments of IM primers use commercially available energetic materials and shipping methods which can reduce reliance on special military documentation. Embodiments can provide prompt, robust, and controlled hot gas output to ignite gun propellant without generating pressure waves. Embodiments provide a primer designed to effect a controlled response to IM stimuli that improves safety of a system in transportation and storage.

An embodiment relates to an IM primer for use with major caliber gun systems, including an elongate housing, a tube, an ignition assembly, and a booster assembly. The elongate housing has a proximal end and a distal end. The tube has a first end coupled within the distal end of the elongate housing. The ignition assembly is located within the proximal end of the housing. The booster assembly is located within the elongate housing adjacent the ignition assembly and including a booster holder providing a cylindrical structure defining an internal bore in which a first burst disk resides and is mechanically restrained by a booster disk lock.

In some embodiments, the distal end of the elongate housing surrounds an adapter that interfaces between the elongate housing and the first end of the tube, wherein the adapter includes a second burst disk.

An embodiment relates to an IM primer for use with major caliber gun systems, including an elongate housing coupled with a tube of narrower cross section. The housing and the tube define a centrally located bore of varying dimension and features. The bore includes an ignition assembly, a booster assembly having a first burst disk, and an adapter having a second burst disk. The first burst disk and the second burst disk are mechanically, bidirectionally, retained in place.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
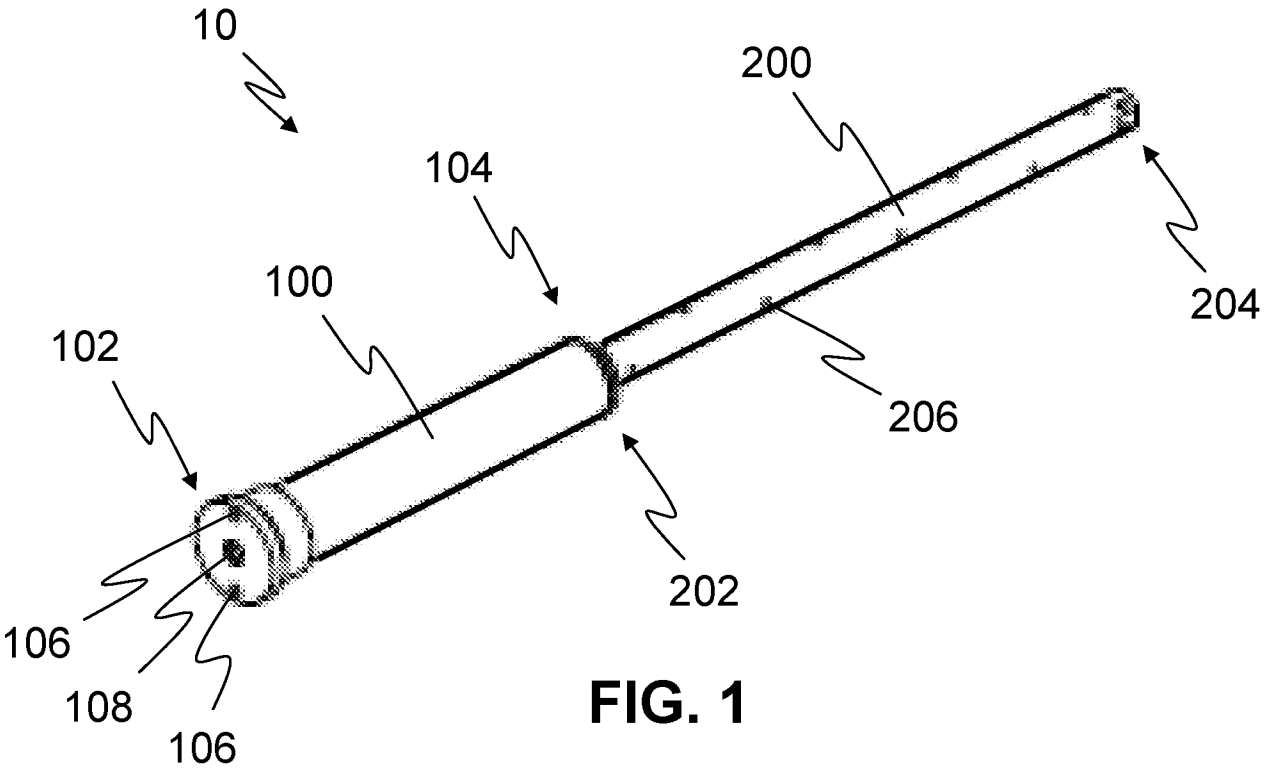
FIG. 1 is a perspective view of an IM primer, according to an embodiment.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Embodiments disclosed generally provide a scalable, electrically initiated, IM primer 10 for major caliber gun systems. In general the IM primer 10 improves the survivability of propelling charge systems to IM stimuli among other features. For example, an IM primer 10 can effect a controlled response to IM stimuli that improves safety of a system in transportation and storage.

FIG. 1 shows a perspective view of an IM primer 10 including a housing 100 and a tube 200. Housing 100 is generally an elongate cylindrical member having a proximal end 102 and a distal end 104. Proximal end 102 is shown with two outer apertures 106 of shallow depth and a central aperture 108 that provides access to the central bore 112 and interior of the housing 100.

FIG. 1 shows tube 200 as an elongate cylindrically-shaped member of smaller diameter and greater length than housing 100. Tube 200 is shown with a first end 202 largely obscured and coupled within the distal end 104 of the elongate housing 100. Tube 200 projects outwardly from the housing 100 in an axially aligned manner to a second end 204 at the distal-most location of the IM primer 10. The tube 200 further is shown to contain a plurality of spaced-apart air vents 206 along its length which can be angled apertures to a central bore (not shown in FIG. 1) in some embodiments.

Figure 1A:
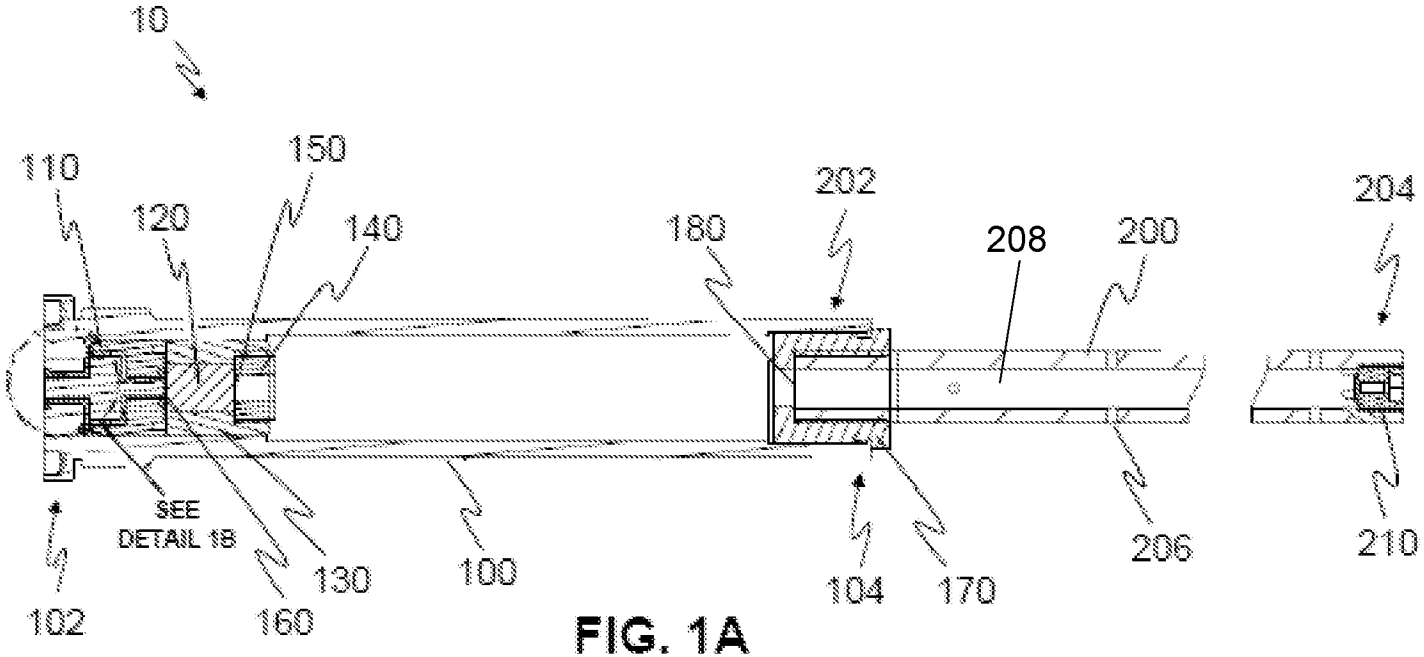
FIG. 1A is cross-sectional view of the IM primer of FIG. 1, according to an embodiment.

FIG. 1A shows a cross-sectional view of IM primer 10 providing a more complete overview of its components. IM primer 10 includes a housing 100 having an ignition assembly 110, and a booster assembly 120 including: a booster holder 130; a burst disk lock 140; a first burst disk 150; and an ignition disk 160. IM primer 10 further includes an adapter 170 and a second burst disk 180 that are located near the distal end of the housing 100. IM primer 10 further includes tube 200. Tube 200 has a first end 202 coupled within the distal end of the elongate housing 100 and adapter 170. Tube 200 further includes air vents 206 along its length and a set screw 210 axially disposed within the distal second end 204.

Second burst disk 180 is generally a thin circular member that helps reduce or prevent flame propagation via the IM primer 10. In some embodiments, first burst disk 150 is similar to second burst disk 180. In some embodiments, however, first burst disk 150 is more robust than second burst disk 180, and is not crimped like second burst disk 180. The burst disks can resist external pressure to several hundred PSI.

Second burst disk 180 generally isolates the primer energetic material from any reaction of the main propellant until a substantial amount of the propellant has been consumed in the ignition resulting from IM stimuli. The diameter of the disk 180 is sized for compatibility with the interior dimensions of the housing 100 and its burn chamber. The second burst disk 180 is generally retained between the burn chamber and the primer adapter 170.

Figure 1B:
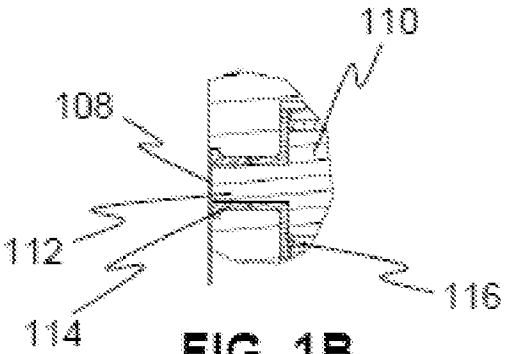
FIG. 1B is a cross-sectional detail view of a portion of the end of the IM primer of FIG. 1 depicting a portion of the ignition assembly, according to an embodiment.

FIG. 1B shows a cross-sectional detailed view of a portion of the proximal end 102 of the IM primer 10. Specifically, a portion of the ignition assembly 110 is shown immediately within the aperture 108. As understood from FIGS. 1A and 1B, the ignition assembly 110 has a narrow initial passage that extends inwardly from the aperture 108 that is surrounded by a primer stock insulator 114. After extending further into the bore 112, the ignition assembly 110 widens in a portion that is surrounded by a bottom insulator 116. Next, a narrow third passage is present leading to the centrally located ignition disk 160 of the booster assembly 120. Ignition assembly 110 should also be understood as being generally threaded into a custom made burn chamber formed within the housing 100. The ignition assembly 110 provides prompt, consistent initiation of the various parts making up the ignition train using standard navy firing current. The ignition components of the ignition assembly can generally be legally transported within approved transportation pipe containers without a government interim hazard classification (IHC).

Figure 2A:
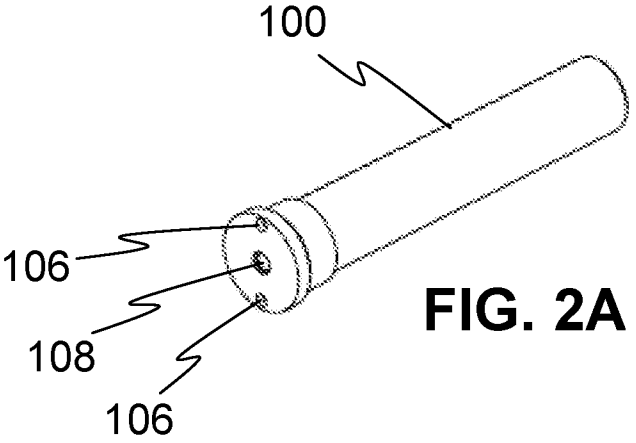
FIG. 2A is a perspective view of the housing of an IM primer, according to an embodiment.
Figure 2B:
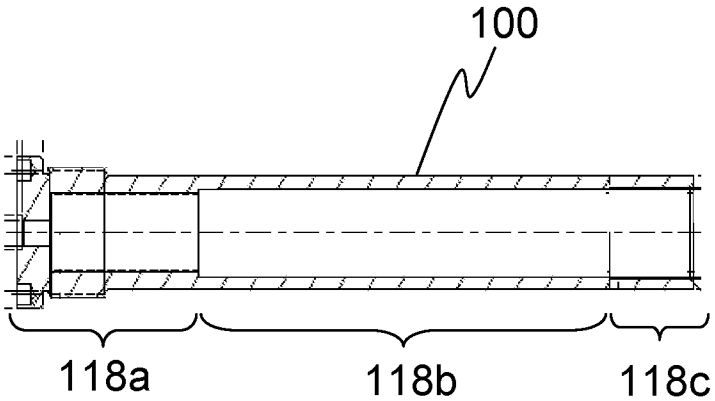
FIG. 2B is a cross-sectional view of the housing of FIG. 2A, according to an embodiment.

In FIG. 2A, a perspective view of the housing 100 of the IM primer 10 is shown. A cross-sectional view of the housing 100 is shown in FIG. 2B. As shown in FIG. 2A, the apertures 106 are located diametrically in-line with the central larger aperture 108 that provides access to the interior of the housing 100. As understood from FIG. 2B the passageway defined by the opening extending through the housing 100 can generally be divided into three sections 118*a*, 118*b*, and 118*c*. The bore comprising these sections can be generally referred to as a burn chamber in some embodiments. Section 118*a* is the proximal-most portion and contains space for the ignition assembly 110 and the booster assembly 120. Section 118*b* contains the large central cavity of the primer 10, and section 118*c* contains space for the adapter 170. Housing 100 is sized to sustain high pressure burning of a primary energetic (black powder having special different size grain than in the booster assembly) and to protect the primary energetic should the gun propellant burn as a result of some external stimuli.

The housing 100 can contain and utilize class 2 black powder as the primary energetic material. Black powder is advantageous as it can generally be legally transported as a flammable solid, without a government IHC. The burn chamber of the housing 100 can be sized to hold as much as 40 grams of black powder. Charge masses of 20 g or 30 g can provide adequate burn pressure and duration in some embodiments.

Figure 3:
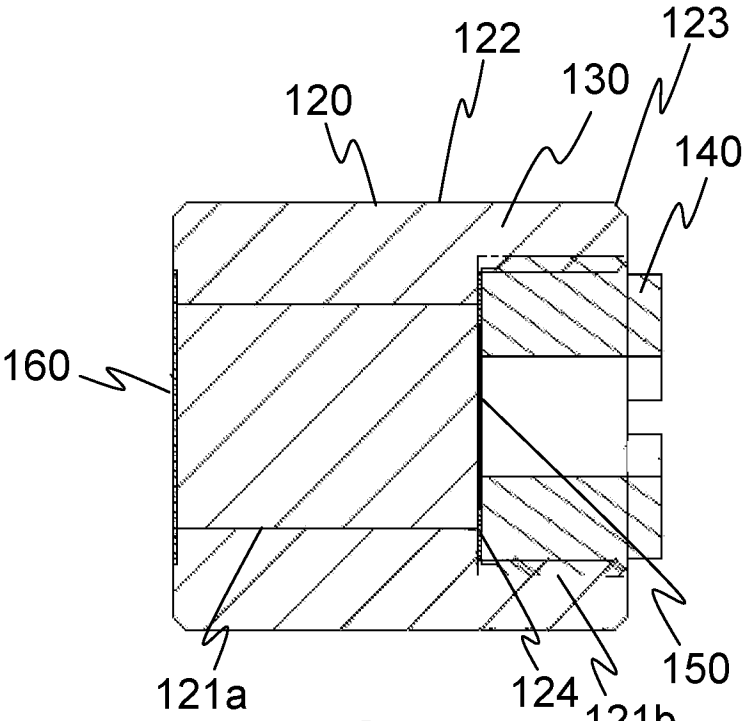
FIG. 3 is a cross-sectional view of the booster assembly, according to an embodiment.

FIG. 3 depicts a cross-sectional view of the booster assembly 120 of the IM primer 10. The booster assembly 120 is largely cylindrical in shape and includes a booster holder 130, a booster disk lock 140, a first burst disk 150 and an ignition disk 160. The booster holder 130 has a smooth, largely cylindrical outer surface 122 with chamfered edges 123 and a multi-dimensioned central passage having a first narrow bore passage 121*a* and a second wide bore passage 121*b*. Juxtaposed adjacent the intersection of these two bores is a burst disk 150 located within the wide bore passage 121*b*. The burst disk 150 can be axially aligned with the wide bore passage 121*b* and narrow bore passage 121*a* in some embodiments. Burst disk 150 has a diameter larger than the narrow bore passage 121*a* and accordingly abuts against the internal annular lip 124 formed between the two passages 121*a* and 121*b*. Also shown located partially within the wide bore passage 121*b* is a booster disk lock 140. Booster disk lock 140 is sized to be secured primarily within the wide bore passage 121*b* and to firmly hold the booster disk 150 in mechanical retention adjacent the opening to the narrow bore passage 121*a*. Adjacent the opposing end of the narrow bore passage 121*a* is an ignition disk 160. Ignition disk 160 provides separation of the interior of the booster assembly 120 from the ignition assembly 110. The arrangement of the booster assembly 120 creates a choked flow region to insure that black powder in the booster assembly 120 is ignited prior to ejection. Significant additional retention of the first burst disk 150 is provided by this arrangement which helps to ensure that it will behave as a burst disk and not be merely expelled intact by unlit black powder. In general, the booster assembly 120 can be said to use bi-directional, mechanical retention and a flow restriction on the outlet for enforced ignition.

Figure 4:
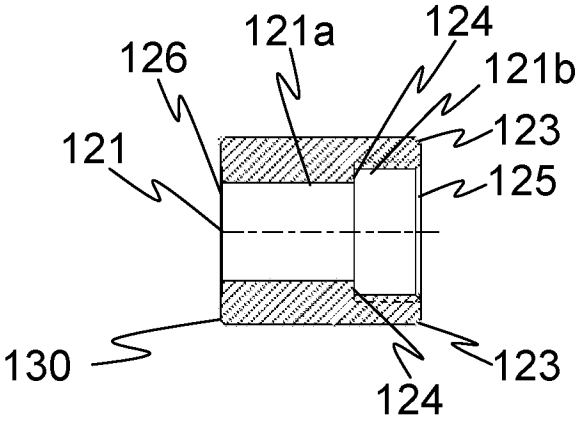
FIG. 4 is a cross-sectional view of the booster holder, according to an embodiment.

FIG. 4 provides a cross-sectional view of the booster holder 130. As understood from these figures, booster holder 130 has a smooth, largely cylindrical outer surface 122 with chamfered edges 123 and a multi-dimensioned central passage 121 having a first narrow bore passage 121*a* and a second wide bore passage 121*b*. Internal annular lip 124 can be seen in the cross-sectional view of FIG. 4. Shallow recesses 125 and 126 on opposing sides of the booster holder 130 provide respective spaces for insertion of the first burst disk 150 and ignition disk 160.

Figure 5:
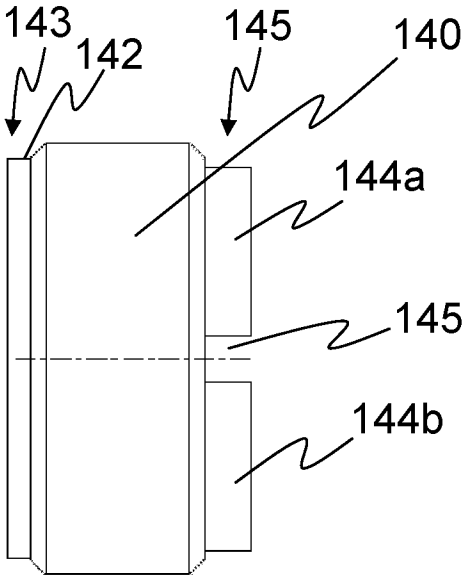
FIG. 5 is a side view of the booster disk lock, according to an embodiment.

FIG. 5 discloses a side view of the booster disk lock 140. As shown, booster disk lock 140 includes a central bore 141, a slightly-recessed, annular lip 142 projecting from one end 143 and semi-circular lips 144*a* and 144*b* projecting from the opposite end 145. A slot 146 is defined between the two semi-circular lips 144*a* and 144*b*. Booster disk lock 140 is sized to be inserted within the wide bore passage 121*b* of the booster holder 130 and to abut up against the first burst disk 150 and press it against the internal annular lip 124 such that the first burst disk 150 is held in bidirectional mechanical retention.

Figure 6:
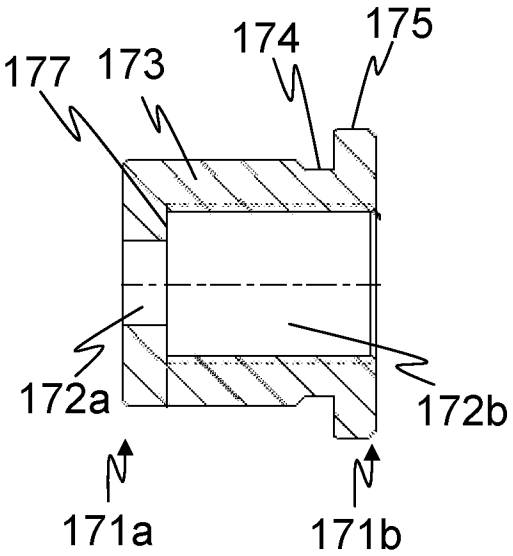
FIG. 6 is a cross-sectional view of the adapter, according to an embodiment.

In FIG. 6, a cross-sectional view of the adapter 170 of the IM primer 10 is shown. Adapter 170 extends from a first end 171*a* to a second end 171*b*. Adapter 170 includes a central bore 172, an cylindrical body portion 173, a outer recessed section 174 and a outwardly projecting head portion 175. Central bore 172 is actually made of two sections, a first bore section 172*a* which is short and narrow in diameter, and a second bore section 172*b* which is longer and wider in diameter. First bore section 172*a* is adjacent end 171*a* while second bore section 172*b* is adjacent end 171*b*. Radially outwardly projecting head portion 175 has a largely circular appearance from the end except for two flattened portions on opposite sides of the central bore 172.

In general, the outside of the cylindrical body portion 173 is intended for insertion within the distal end of the housing 100 of an IM primer 10. The outwardly projecting head portion 175 is to reside outside the housing 100 and abut up against its end. A second burst disk 180 fits within the bore 172 at the intersection of the two bores 172*a* and 172*b*. At this location, the second burst disk 180 is held up against an internal annular lip 177. Further, the tube 200 of the IM primer 10 is intended to couple within the bore 172 and, more specifically, be located within the bore 172*b* such that it abuts up against the second burst disk 180. This arrangement permits advantageous mechanical retention of the second burst disk 180.

Figure 7A:
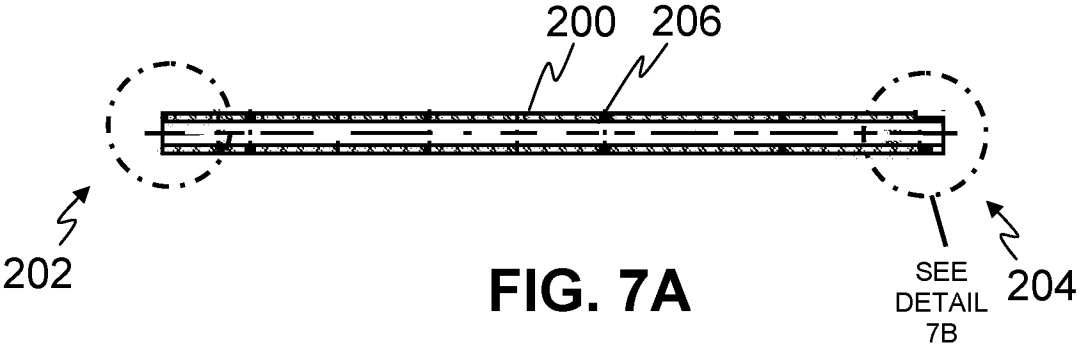
FIG. 7A is a cross-sectional view of the tube, according to an embodiment.
Figure 7B:
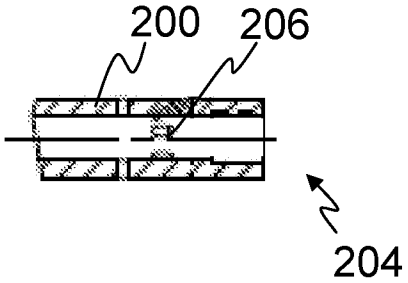
FIG. 7B is a cross-sectional detailed view of an end of the tube of FIG. 7A, according to an embodiment.

In FIG. 7A, a cross-sectional view of the tube 200 IM primer 10 is shown extending from a first end 202 to a second end 204. When assembled first end 202 is proximally located and largely obscured and coupled within the distal end 104 of the elongate housing 100. Further, tube 200 projects outwardly from the housing 100 in an axially aligned manner to the distally located second end 204 at the distal-most location of the IM primer 10. A cross-sectional detailed view of the other end of the tube 200 is shown in FIG. 7B.

Tube 200 is generally fabricated from high pressure tubing. Tube 200 has an outer diameter that is compatible to fit within the adapter 170 and corresponding smaller center bore 208. Along the length of the tube 200 are spaced apart air vents 206. In some embodiments, there can be seventeen vent holes 206, for example. The cross-sectional area of all these air holes may be similar to the cross-sectional area of the adapter 170 in some embodiments. Based on the air flow permitted through the tube 200, the initial flow restriction is generally created by the adapter 170. Various lengths of tube 200 are possible. In some examples, an eleven inch tube can be used. The inlet to the tube 200 and the tube air vents 206 are sizeable to sustain and distribute gas generate during high pressure burning of the primary energetic. The length of the tube 200 is adjusted to the end use to protect it and the housing from external mechanical forces. It is also noted that the mass of the primary energetic is also scalable for larger volume propelling charge cartridge volumes. In one example, the IM primer 10 can be used with five inch propelling charges. However, other size charges for major caliber gun systems can be used as well. The distal second end 204 of the tube 200 contains a set screw 210. Accordingly, the distal interior at second end 204 is adapted for receiving a threaded set screw 210.

Figure 8:
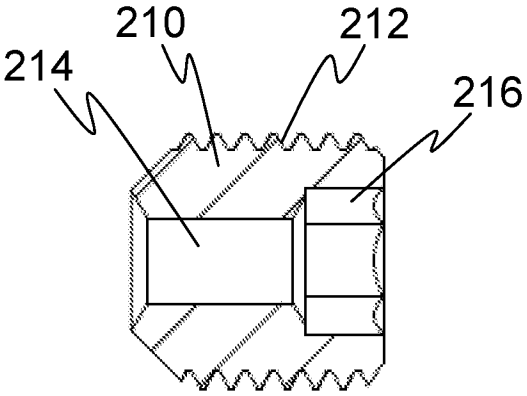
FIG. 8 is a cross-sectional view of the set screw.

FIG. 8 is a cross-sectional view of the set screw 210 used in the distal second end 204 of the IM primer 10. Set screw 210 allows for restricted access to the center bore 208 of the tube 200. The outside of set screw 210 contains threads 212. The interior of the set screw 210 has a central bore 214 as well an end 216 that is keyed for tightening with a tool.

In general, the overall IM primer 10 is safe to assembly and handle using standard workplace practices. The ignition assembly 110 and booster assembly 120 can be installed sequentially into the burn chamber defining the interior bore of the housing 100 using special spanners. The primer tube 200 with corresponding second burst disk 180 and adapter 170 become a completely inert subassembly that is attached to the burn chamber after it is filled with the specified mass of black powder. The igniter is HERO safe after installation in the cartridge case. Further, many of the components of the IM primer 10 are reusable after minor disassembly and cleaning operations.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. An insensitive munitions (IM) primer for use with major caliber gun systems, comprising:

an elongate housing having a proximal end and a distal end;

a tube having a first end coupled within the distal end of the elongate housing;

an ignition assembly located within the proximal end of the housing, said ignition assembly including an ignition charge;

a booster assembly for holding a booster charge located within the elongate housing adjacent the ignition assembly wherein an ignition disk separates the booster assembly from the ignition assembly, said booster assembly including a booster holder providing a cylindrical structure defining an internal bore in which a first burst disk resides and is mechanically restrained by a booster disk lock, wherein the distal end of the elongate housing surrounds an adapter that interfaces between the elongate housing and the first end of the tube, wherein the adapter includes a second burst disk that abuts the tube, and a burn chamber for holding a primary energetic material charge disposed within the elongate housing between the first burst disk and the second burst disk.

2. The insensitive munitions (IM) primer of claim 1, wherein the tube contains a plurality of spaced-apart air vents along its length.

3. The insensitive munitions (IM) primer of claim 1, wherein the booster disk lock enables bidirectional mechanical retention of the first burst disk.

4. The insensitive munitions (IM) primer of claim 1, wherein the first burst disk is not crimped.

5. The insensitive munitions (IM) primer of claim 1, wherein the IM primer is configured for use with projectiles having mid-body obturators.

6. The insensitive munitions (IM) primer of claim 1, wherein the tube includes a set-screw at a second end.

7. The insensitive munitions (IM) primer of claim 1, wherein the booster assembly comprises an outlet that restricts flow of the booster charge contained in the booster assembly for enforced ignition of the primary energetic material charge within the burner chamber.

8. The insensitive munitions (IM) primer of claim 1, wherein the first burst disk is resistant to over 300 psi of external pressure.

9. The insensitive munitions (IM) primer of claim 1, wherein the IM primer is scalable for use with charges of major caliber gun systems greater than five inches.

10. The insensitive munitions (IM) primer of claim 1, wherein the IM primer can be used with five inch propelling charges.

11. An insensitive munitions (IM) primer for use with major caliber gun systems, comprising:

an elongate housing coupled with a tube of narrower cross section, wherein the housing and tube define a centrally located bore;

wherein the bore includes an ignition assembly, a booster assembly having a first burst disk, and an adapter having a second burst disk;

said ignition assembly including an ignition charge;

said booster assembly containing a booster charge isolated on a first end by an ignition disk and the opposing end by the first burst disk, and wherein the first burst disk and the second burst disk are mechanically, bidirectionally, retained in place, and a burn chamber is disposed between the first burst disk and the second burst disk, said burn chamber containing a primary energetic material.

12. The insensitive munitions (IM) primer of claim 11, wherein the tube contains a plurality of spaced-apart air vents along its length.

13. The insensitive munitions (IM) primer of claim 11, wherein the first burst disk is not crimped.

14. The insensitive munitions (IM) primer of claim 11, wherein the booster assembly comprises an outlet that restricts flow of the booster charge contained in the booster assembly for enforced ignition of the primary energetic material.

15. The insensitive munitions (IM) primer of claim 11, wherein the tube includes a set-screw at a distal end.

16. The insensitive munitions (IM) primer of claim 11, wherein the IM primer can be used with five inch propelling charges.

* * * * *